US005707345A

United States Patent [19]

Fulk

[11] Patent Number: 5,707,345

[45] Date of Patent: Jan. 13, 1998

[54] METHOD FOR TREATING CARPAL TUNNEL SYNDROME

[75] Inventor: Paul F. Fulk, West Carrollton, Ohio

[73] Assignee: Para Tech Industries, Inc., Dayton, Ohio

[21] Appl. No.: 113,369

[22] Filed: Aug. 30, 1993

Related U.S. Application Data

[63] Continuation-in-part of Ser. No. 989,698, Dec. 14, 1992, abandoned.

[51] Int. Cl.[6] ..... A61H 1/00

[52] U.S. Cl. ..... 601/33; 601/5; 601/26; 128/898

[58] Field of Search ..... 482/44; 602/21, 602/32–36; 606/241; 601/101, 105, 5, 26, 33, 40, 58, 100; 128/878, 898, 782, 774; 73/379.01

[56] References Cited

U.S. PATENT DOCUMENTS

| | | | |
|---|---|---|---|
| 1,662,464 | 3/1928 | McCutchen | 602/36 |
| 2,273,088 | 2/1942 | Byers | 601/26 |
| 2,511,182 | 6/1950 | Spencer | 602/36 |
| 2,515,590 | 7/1950 | Chaffin | 602/36 |
| 3,631,542 | 1/1972 | Potter | 128/26 |
| 5,123,916 | 6/1992 | Riddle et al. | 606/243 |
| 5,163,443 | 11/1992 | Fry-Welch et al. | 128/782 |
| 5,181,904 | 1/1993 | Cook et al. | 606/241 |
| 5,256,136 | 10/1993 | Sucher | 602/21 |
| 5,301,683 | 4/1994 | Durkan | 128/774 |

FOREIGN PATENT DOCUMENTS

| | | | |
|---|---|---|---|
| 0479688 | 4/1992 | European Pat. Off. | 128/774 |
| 0073434 | 2/1894 | Germany | 128/26 |
| 1417892 | 8/1988 | U.S.S.R. | 482/44 |
| 1595514 | 9/1990 | U.S.S.R. | 128/26 |
| 8702567 | 5/1987 | WIPO | 128/782 |

OTHER PUBLICATIONS

Carpal Tunnel Syndrome, 1976, Systems DC., pp. 288–290.

*Primary Examiner*—Jeanne M. Clark
*Attorney, Agent, or Firm*—William Weigl

[57] ABSTRACT

A method and apparatus for relieving symptoms of carpal tunnel syndrome includes restraining the elbow of the patient from movement while applying pressure to the wrist to move the wrist in a direction away from the elbow. The method further includes rotating the wrist during movement of the wrist away from the elbow.

13 Claims, 10 Drawing Sheets

METHOD FOR TREATING CARPAL TUNNEL SYNDROME

RELATED U.S. APPLICATION DATA

Continuation-in-Part of Ser. No. 07/989,698, filed Dec. 14, 1992, now abandoned.

The present invention relates to the treatment of hand disorders and, more particularly, to a method and apparatus for relieving hand disorders due to carpal tunnel syndrome.

BACKGROUND OF THE INVENTION

In recent years a new medical problem has appeared. People have reported having aggravating symptoms of weakness and clumsiness in hand functions with altered sensations such as numbness of the thumb, index finger and the middle and radial part of the ring finger. These symptoms were described as wrist level median nerve entrapment and later identified as carpal tunnel syndrome. Workers that are at risk for carpal tunnel syndrome due to repetitive tasks include computer operators, typists, stenographers, garment workers, seamstresses, chiropractors, masseurs, butchers, packers, assembly line workers, tennis players, golfers and other people involved in sport activities or where the impact and twisting of the forearm and hand preclude themselves to injury and ultimately resulting in carpal tunnel syndrome.

It is therefore a principal object of the present invention to provide a method and apparatus for relieving the symptoms of carpal tunnel syndrome.

It is another object of the present invention to provide such an apparatus which can be interrupted during treatment by the patient.

It is a further object of the present invention to provide such an apparatus in which the amount and duration of the force used to relieve the symptoms of carpal tunnel syndrome is controlled.

It is yet another object of the present invention to provide an apparatus for use in the treatment of carpal tunnel syndrome which is simple in construction and low in cost.

SUMMARY OF THE INVENTION

There is provided, in accordance with the present invention, a method and apparatus for use in the treatment of carpal tunnel syndrome which includes a support member on which the arm of the patient is positioned. The elbow of the arm is held in a restrained position on the support member. The wrist is attached by means of a pair of strap members or other conventional connecting means to a pneumatic actuator or traction device. Upon operation of the actuator, pressure is exerted upon the wrist by the attached strap members. The resulting extension of the arm and the wrist causes a reduction in the compression of the carpal tunnel ligament upon the median nerve in the wrist relieving the pressure on the nerve reducing the symptoms of car pal tunnel syndrome. Control means are provided for controlling the amount and duration of the pressure applied to the wrist and allowing the patient to stop the application of pressure to the wrist when such application becomes uncomfortable. The strap members are oriented to rotate the arm and wrist during the extension of the arm and wrist by the strap members.

BRIEF DESCRIPTION OF THE DRAWINGS

Additional advantages and meritorious features of the present invention will become more apparent and fully understood from a reading of the following detailed description and appended claims when read in conjunction with the drawings wherein like reference numerals indicate like or corresponding elements throughout the several views and wherein:

DETAILED DESCRIPTION OF THE PREFERRED EMBODIMENT

Figure 1:
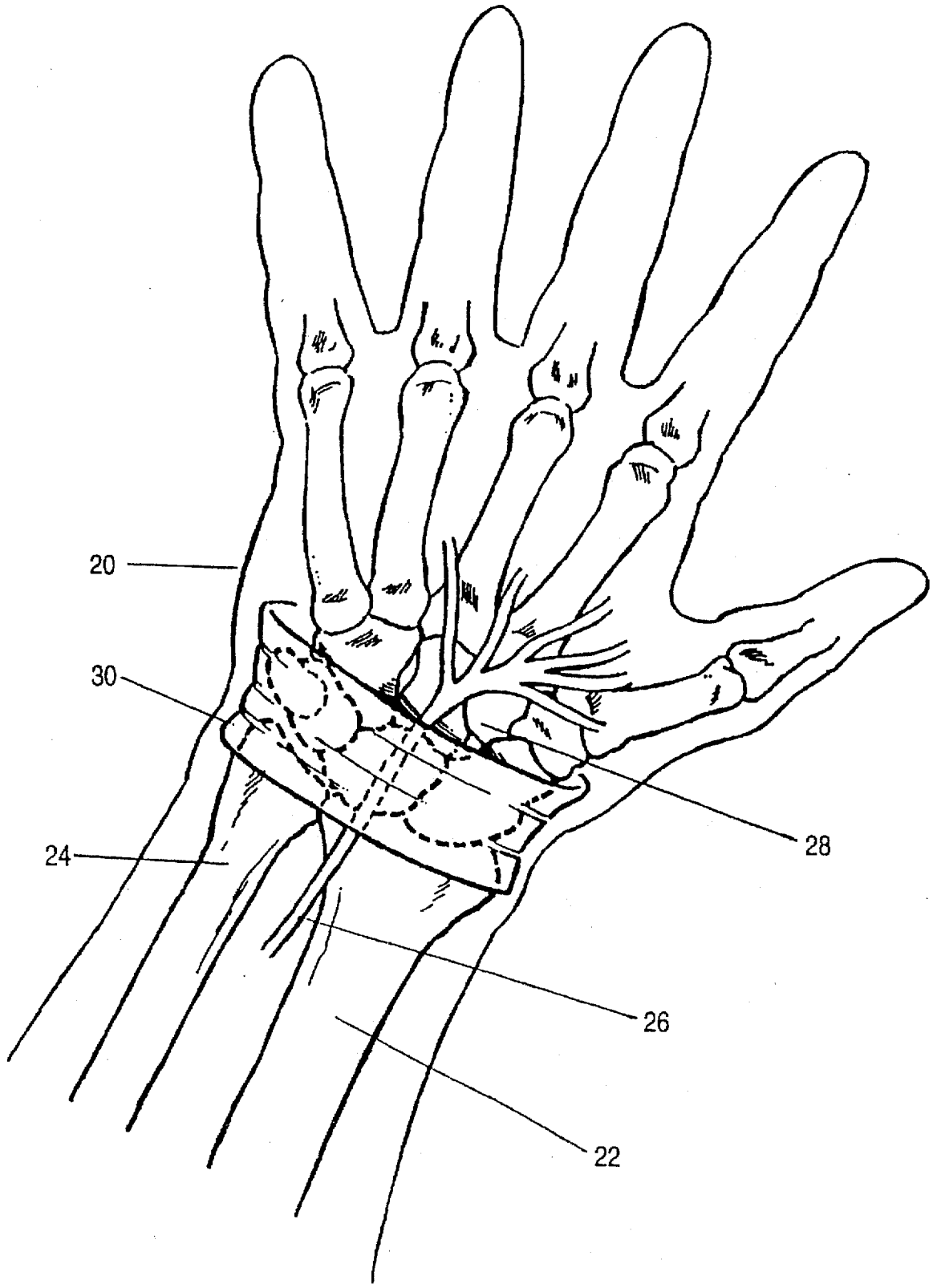
FIG. 1 is a schematic representation of the hand and wrist showing the location of the elements which produce carpal tunnel syndrome.

Referring now to FIG. 1, there is shown a schematic representation of the hand and wrist area of the arm indicated generally by the numeral 20 which includes the end portions of the radius bone 22 and the ulnar bone 24 both of which extend along the forearm to the elbow. As they extend towards the elbow, they overlap each other (not shown). Extending along the arm and between the radius bone and the ulnar bone and into the hand is the median nerve member 26. Positioned at the base of the hand in the wrist area are eight carpal bones 28 arranged to form a groove through which the median nerve extends. Surrounding the carpal bones on three sides is the palmar car pal ligament 30 forming a tunnel with the carpal bones. Repetitive motion of the forearm and hand together with the impact of the hand on the keyboard of a computer or any other surface with which the hand is associated results in the application of a slight torque to the radius and ulnar bones resulting in the proximal compression and reposition of the radius and ulnar bones. This action results in the subsequent tightening of the transverse palmar carpal ligament 30 about the carpal bones 28 and the reduction of the cross-section of the tunnel compressing the median nerve 26 thereby producing carpal tunnel syndrome.

Figure 2:
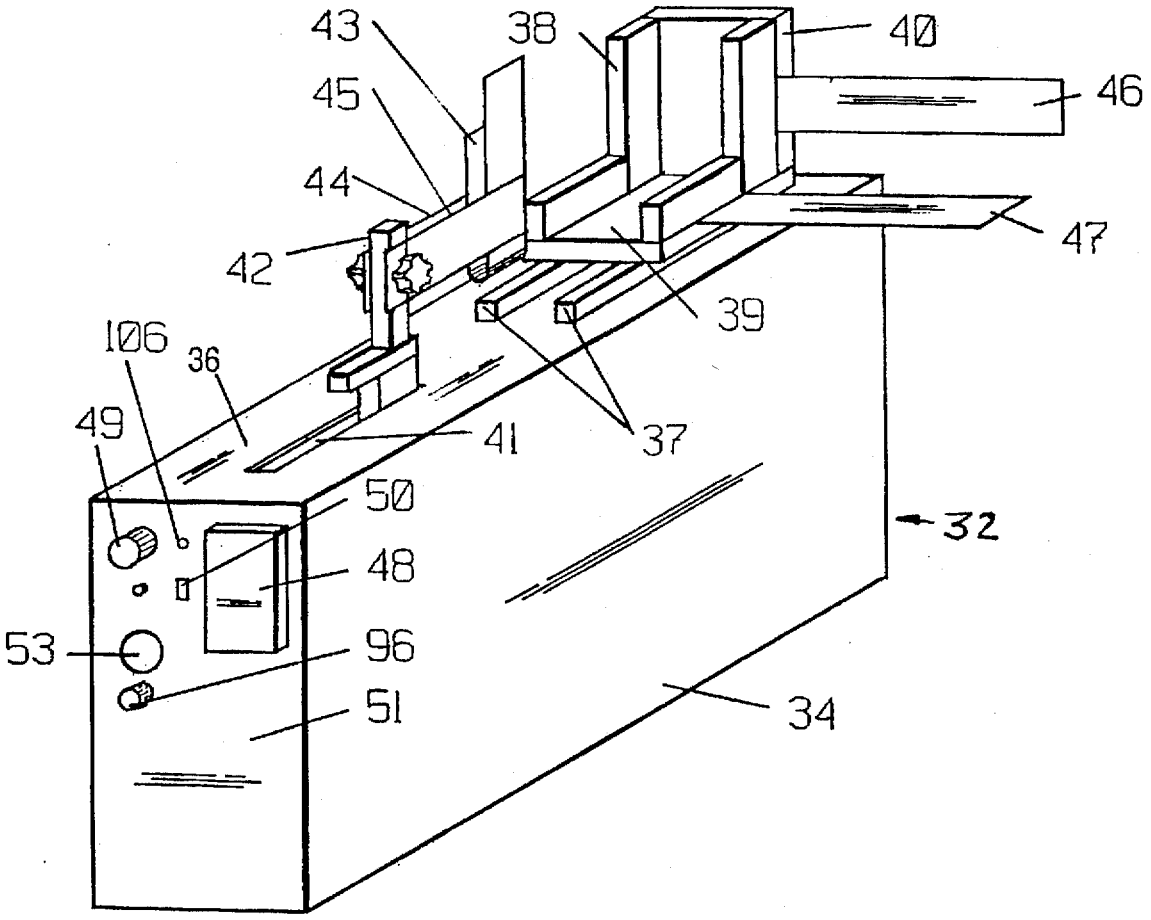
FIG. 2 is a top front oblique view of the housing member used in the treatment of carpal tunnel syndrome showing the location of the arm support member and the straps for securing the arm and the elbow to the arm support member and the wrist to the wrist drive member.
Figure 7:
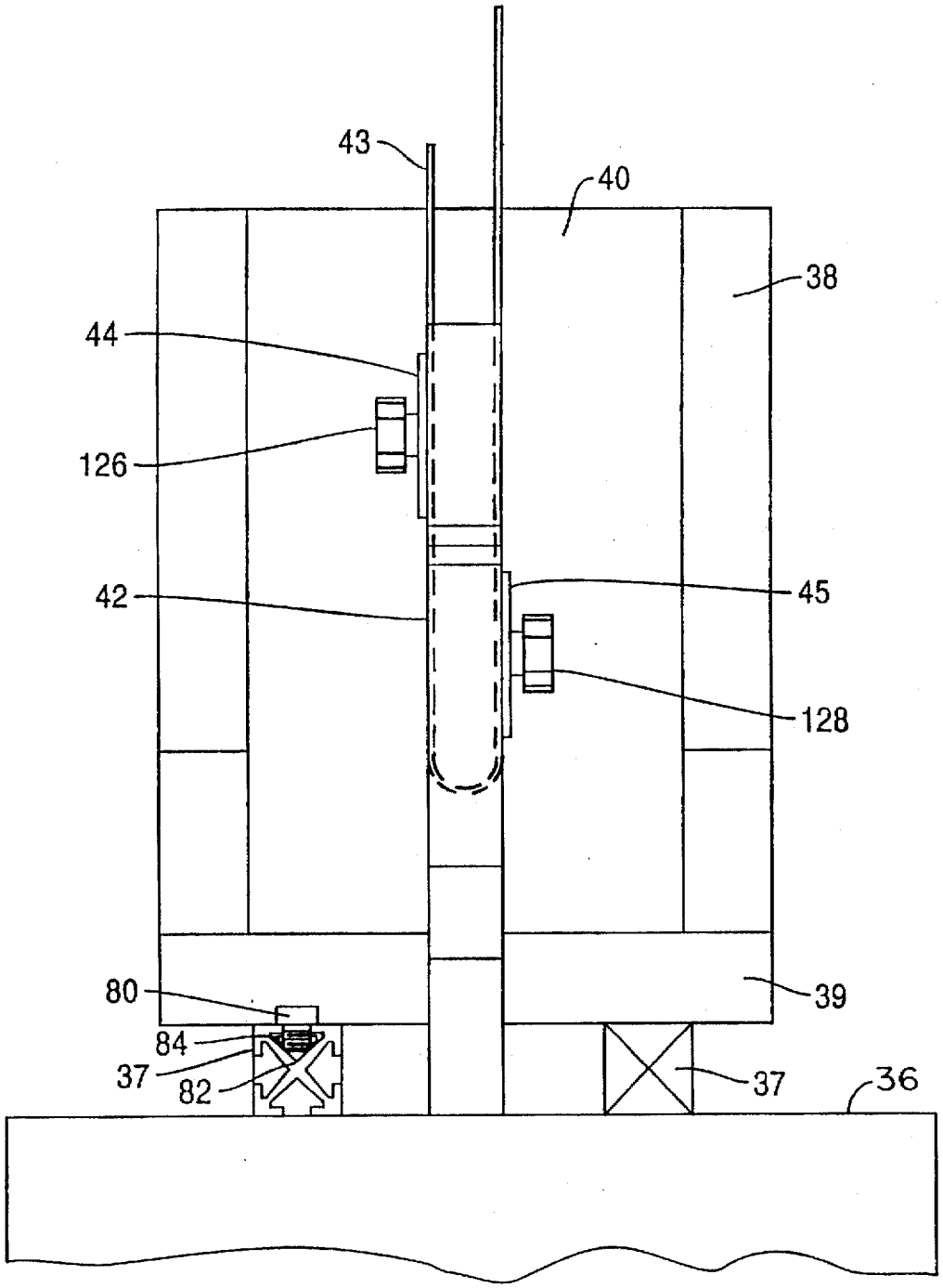
FIG. 7 is an enlarged partial front view of the arm support member with a portion of one of the extruded rail members removed showing the locking members for locking the arm support member in an adjusted position on the rail members and also the mounting of the strap members on the wrist drive member to rotate the wrist and arm during the extension movement of the wrist and arm.
Figure 10:
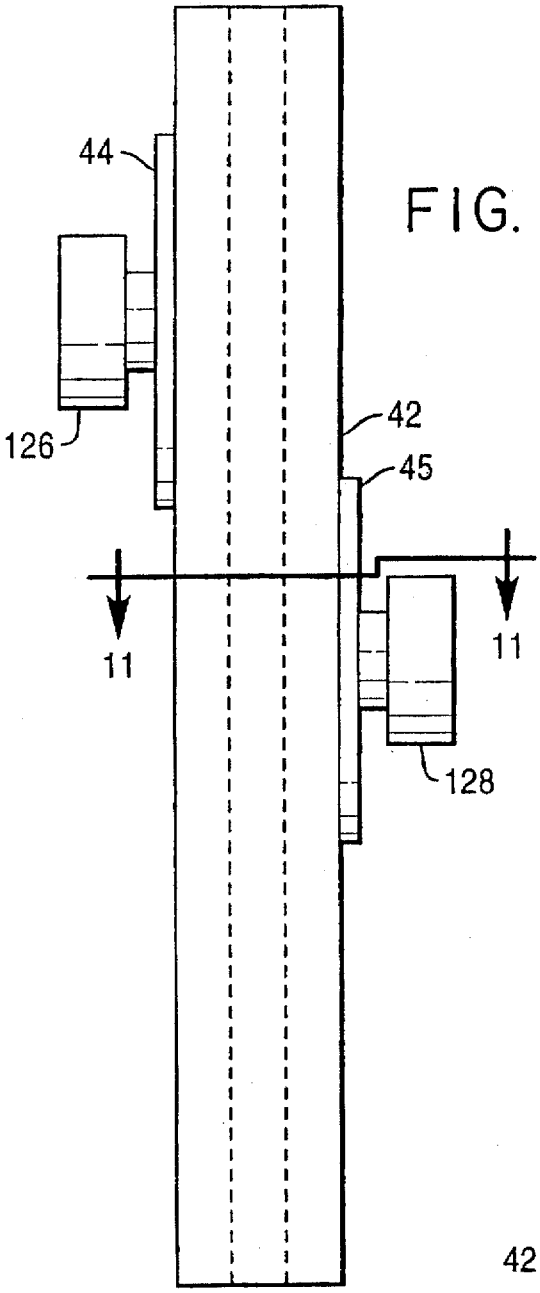
FIG. 10 is a partial front view of the wrist drive member showing the positioning of the strap members on the wrist drive member for rotating the arm and wrist during the time the arm and wrist are being extended by operation of the drive member.

Referring now to FIG. 2 there is shown a top front oblique view of the apparatus or therapy device of the present invention generally indicated by the numeral 32 which includes a housing member 34 having a top surface 36 on which a pair of rail members 37 and an arm support member 38 is mounted. The support member 38 comprises a horizontally extending forearm support portion 39 and a vertically extending back portion 40 for engaging and supporting the elbow and the upper arm portion of the patient in a manner that will be described more fully hereinafter. Extending through an aperture 41 in the surface 36 is a wrist drive member 42 to which is attached a pair of strap members 44 and 45 which constitute a pair of reins. In the present embodiment, the strap members 44, 45 are attached to and support a strap member 43 which may be composed of an attaching material such as Velcro, a registered trademark of American Velcro Inc., allowing the strap member 43 to be fitted as a harness around the wrist of a patient whose forearm and elbow are resting on the support portion 39. As will be described more fully hereinafter, the elbow is secured to the support member by means of strap members 46, 47 in the same manner as that of the wrist. Upon the forward movement of the drive member 42, the wrist will be distracted from the elbow relieving the compression of the palmar carpal ligament 30 (FIG. 1) upon the median nerve 26 thus alleviating the pressure on the median nerve and the symptoms of carpal tunnel syndrome. As best shown in FIGS. 7 and 10, the strap members 44 and 45 are mounted on the drive member 42 offset to each other to apply a twisting motion on the wrist and forearm during the distracted movement of the wrist aiding in relieving the symptoms of carpal tunnel syndrome. Mounted on the front panel 51 of the housing member 34 is a standard intervalometer member 48 for setting the time period during which pressure is applied to the drive member 42, a manual regulator knob 96 for controlling the amount of pressure applied to an pneumatic actuator 58 (FIG. 3), a pressure gauge 53 indicating the pressure being applied to the actuator 58, an emergency stop button 49, a power indicator 106 and a compressor cutoff switch 50.

Figure 3:
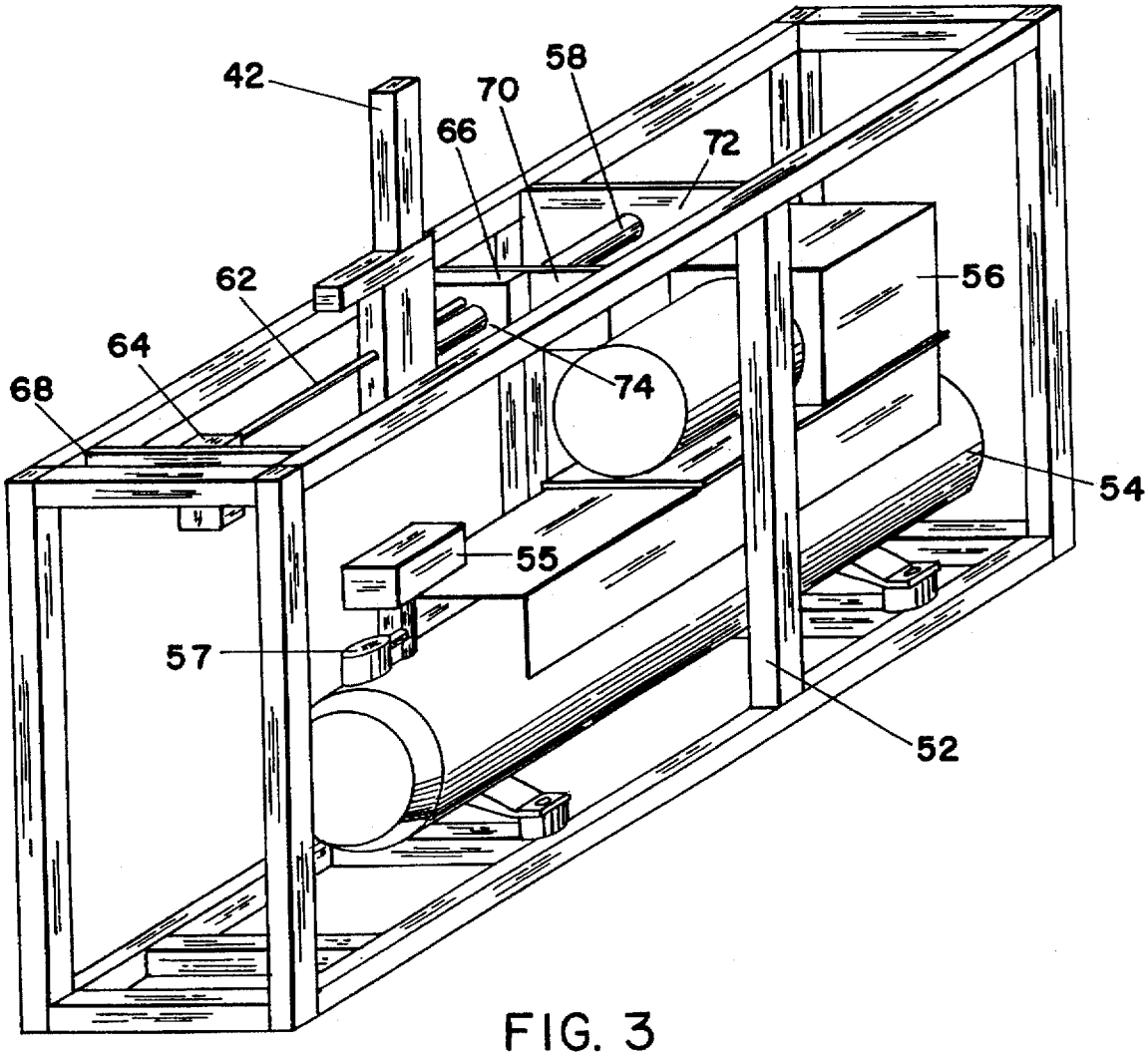
FIG. 3 is a view similar to FIG. 2 with the walls of the housing member removed showing the pneumatic elements which form the drive system for actuating the wrist drive member.
Figure 4:
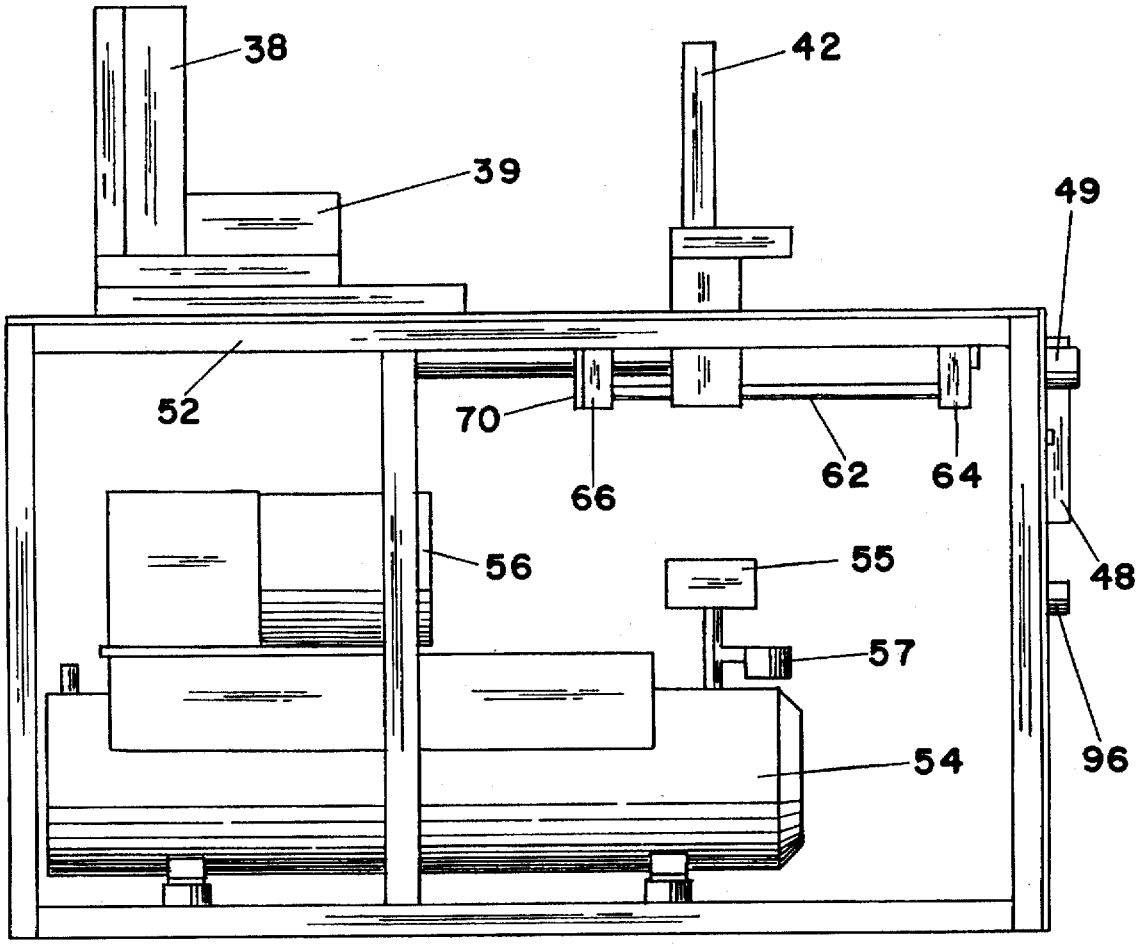
FIG. 4 is a side view of the housing member shown in FIG. 3.
Figure 5:
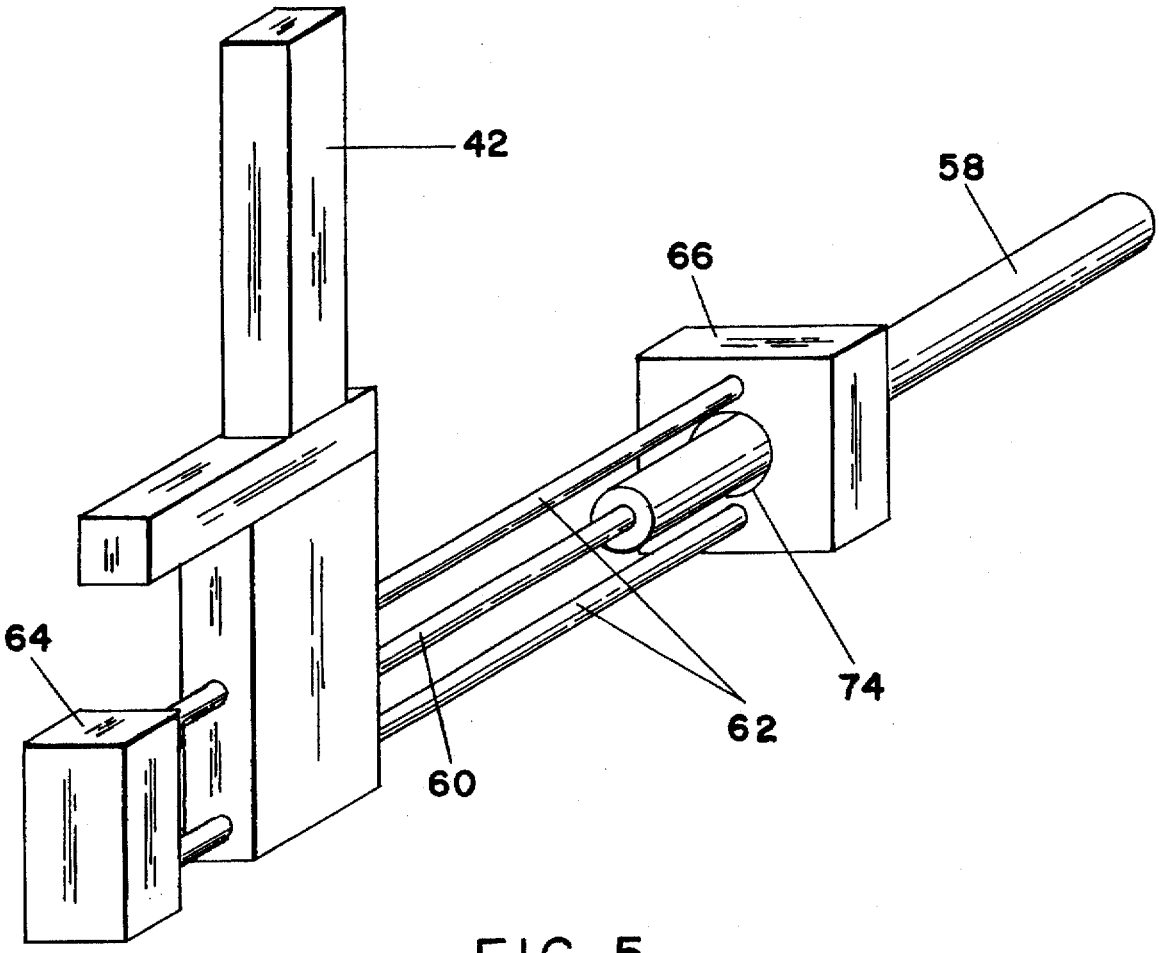
FIG. 5 is a top front oblique view of the actuator system for driving the wrist drive member.
Figure 6:
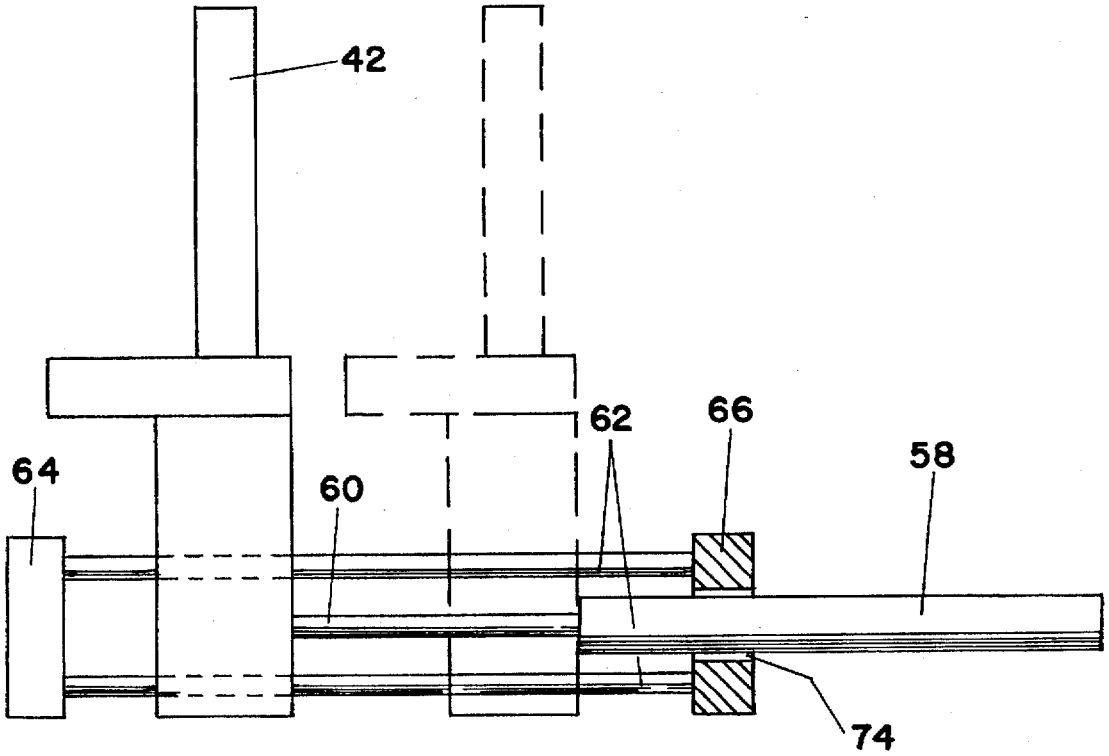
FIG. 6 is a side view of the actuator system shown in FIG. 5 showing the extent of movement of the wrist drive member by the actuator member.

Referring now to FIG. 3 there is shown a top front oblique view of the housing member with the outer walls removed which includes a box-like frame structure 52 within which is mounted an 120 psi air tank 54, an air compressor 56 for supplying air to the tank 54 and the pneumatic actuator 58 which includes a piston member 60 (FIG. 6) one end of which engages the drive member 42. Mounted to the air tank 54 is a pressure switch 55 and an air pressure gage 57 indicating the air pressure in the tank 54. As best seen in FIGS. 4, 5 and 6, the wrist drive member 42 is slidably mounted on a pair of support rod members 62. The rod members 62 are mounted between a pair of support members 64 and 66 which in turn are secured to a pair of cross frame members 68 and 70 respectively (FIG. 3). The piston member 60 is mounted between a cross frame member 72 and the frame member 70 and is positioned within an aperture 74 located in the support member 66. FIG. 6 illustrates the maximum length of travel of the wrist drive member 42 by the piston 60 upon operation of the actuator 58. The extension of the wrist drive member 42 is dependent on the location of the elbow on the arm support member 38 at the start of the operation of the actuator 58 and the horizontal movement of the wrist drive member 42 away from the elbow.

Referring now to FIG. 7, there is shown a enlarged front view of the arm support member 38 with an end portion of a rail member 37 removed to show details of the locking members for slidably locking the arm support member 38 to the rail members 37. Mounted on the arm support member 38 is a screw member 80 having a threaded end which extends into a V-shaped recessed portion 82 of the rail member 37. Secured to the threaded end of the screw member is a nut member 84 which, upon rotation of the screw member 80, will be drawn up against the top edge of the recessed portion 82 of the rail member 37 locking the arm support member 38 to the rail members 37. Also shown in FIG. 7 are a pair of screw members 126 and 128 which are slidably mounted in the drive member 42 for attaching the strap members 44 and 45 respectively to the drive member 42 in a manner so as to rotate the wrist and arm in a clockwise or counterclockwise direction as viewed in FIG. 7. As will be described more fully hereinafter, the mounting of the screw members 126 and 128 within the drive member 42 is the same as the mounting of the screw member 80 within the rail member 37.

Figure 8:
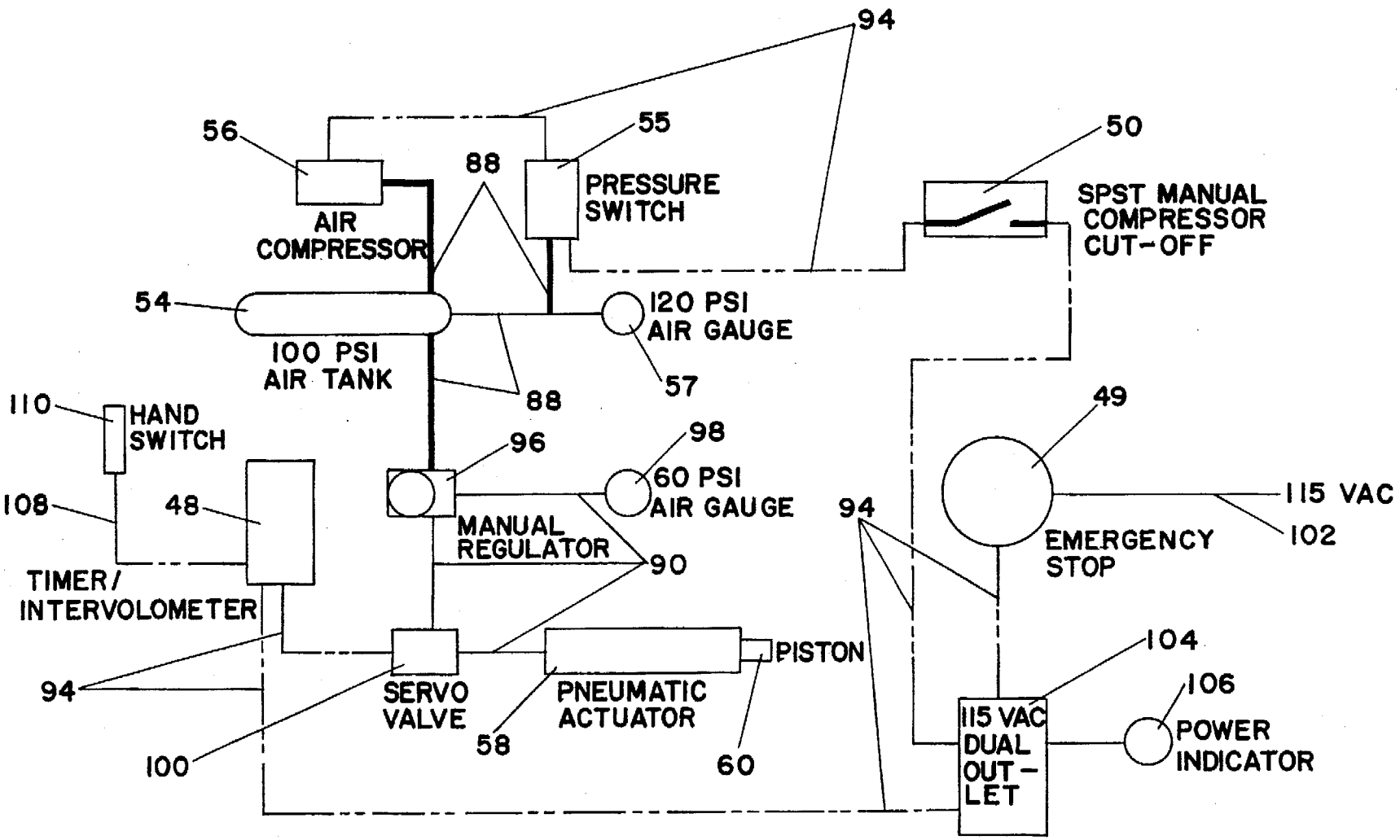
FIG. 8 is schematic representation of the drive systems for operating the pneumatic actuator and the control circuit for controlling the operation of the pneumatic drive systems.

Referring now to FIG. 8, there is disclosed a schematic representation of the drive systems used to control the operation of the pneumatic actuator 58 for moving the wrist drive member 42 in a direction away from the wrist. Included in the drive systems is a high pressure line system represented by lines 88, a low pressure line system indicated by the dotted lines 90 and a 115 AC electrical circuit indicated by the phantom lines 94.

Included in the high pressure system is the air compressor 56, the air tank 54 which is normally maintained at a pressure of 100 psi, the pressure switch 55 which senses the pressure in the tank 54 and operates the compressor 56 when the pressure in the tank reaches 60 psi and the

100psi air gage 57 which indicates the pressure level in the tank. Included in the low pressure system is the manually operated pressure regulator 96 connected to a 60 psi air pressure gauge 98 and a servo valve 100. When operated, the regulator 96 regulates the pressure from the tank 54 to the level indicated on the gauge 98 which normally in the present invention is 30 psi. The servo valve 100 is connected to the pneumatic actuator 58 and controls the amount of air pressure applied to the actuator 58. The electrical circuit system includes a 115 AC voltage source appearing on line 102 to the emergency stop button 49 located on the front panel 51 of the housing member 34 (FIG. 2). The stop button 49 is electrically connected to a 115 VAC dual outlet box 104 which is connected to a power indicator 106, the intervalometer 48 (FIGS. 2 and 9) and the manual compressor cut-off switch 50 (FIG. 2). The cut-off switch 50 is electrically connected to the pressure switch 55 (FIG. 3) which in turn is connected to the compressor 56. Actuation of the cut-off switch 50 will disable the pressure switch and the operation of the compressor 56. The intervalometer 48 is electrically connected to the servo valve 100. Connected to the intervalometer 48 by means of an electrical cable 108 is a remote cut-off switch 110 which can be given to the patient allowing the patient to disable the pressure being applied to the wrist by actuation of the switch which enables the servo valve 100 to relieve the air pressure being applied to the piston 60.

Figure 9:
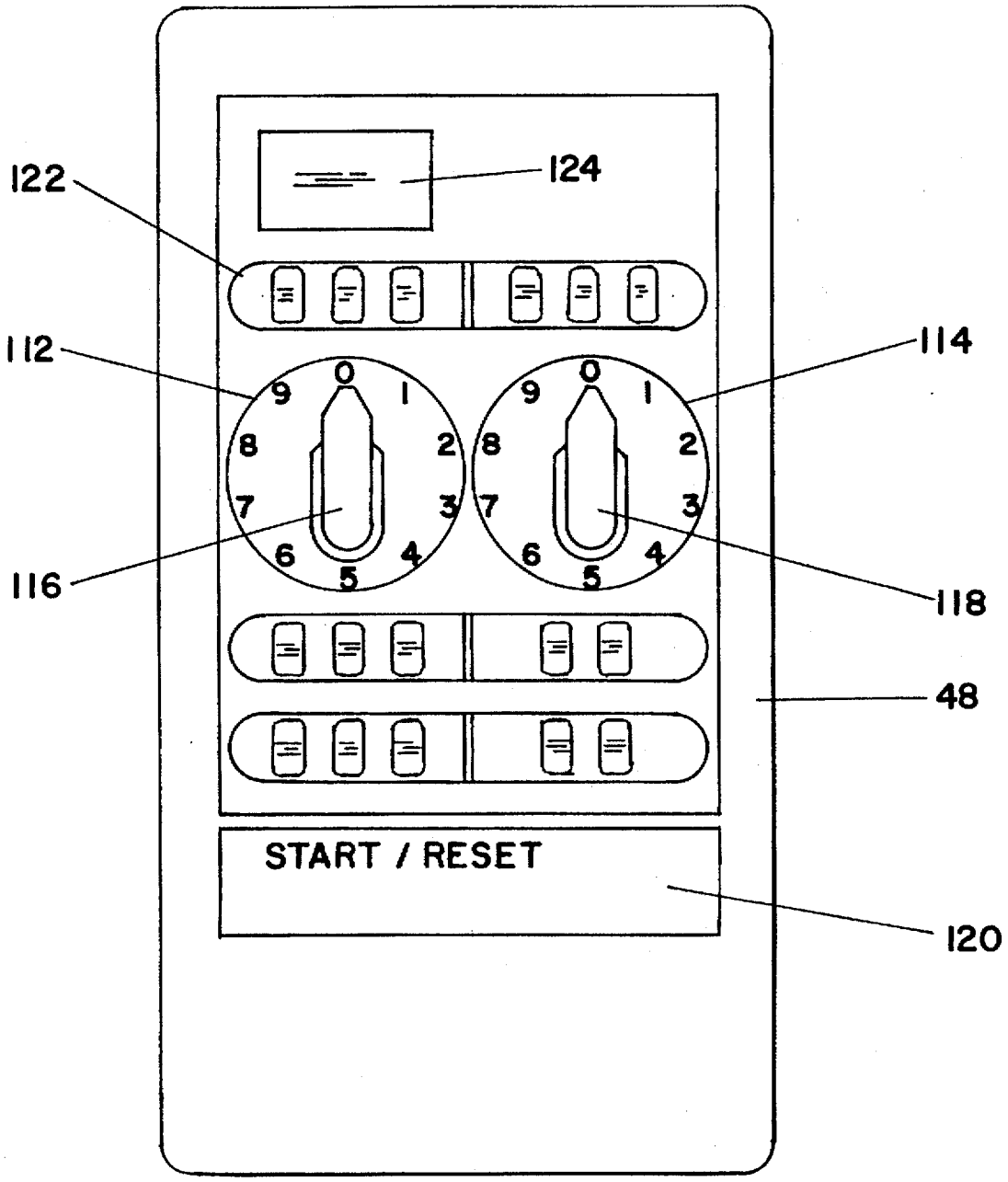
FIG. 9 is a front view of a typical intervalometer showing the control buttons for controlling the drive period of the wrist drive member.

Referring to FIG. 9, there is shown a plan view of the intervalometer 48 (FIGS. 2 and 8) which may be of any standard construction. One example of a commercially available timer that may be used is the GraLab 451 manufactured by the Dim co-Gray Co. of Centerville, Ohio. The intervalometer 48 includes a pair of dial members 112 and 114 including pointers 116 and 118 respectively for setting the time interval during which pressure is to be applied to the wrist and a start/reset bar 120 for starting and resetting the operation of the apparatus. Control buttons 122 control the starting of the timer operation while the displays 124 indicate the time remaining of the time interval selected.

Figure 11:
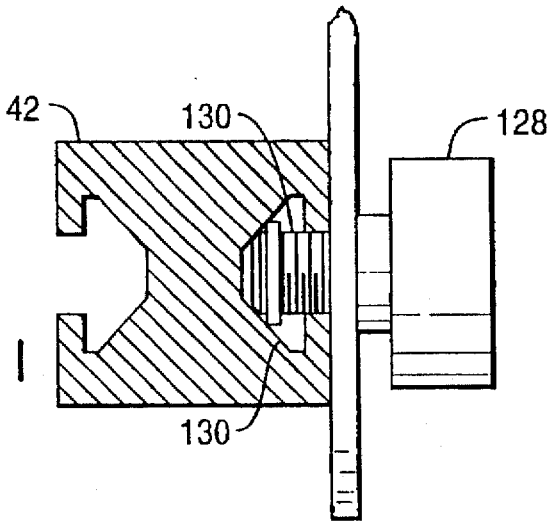
FIG. 11 is a sectional view taken on lines 11—11 of FIG. 10 showing details of the screw members used to mount the strap members to the wrist drive member.

Referring now to FIG. 10, there is shown an enlarged partial front view of the wrist drive member 42 comprised of a rail member similar to the rail member 37 (FIG. 7) and which includes a V-shaped recessed portion 130 (FIG. 11) extending along the length of the rail member into which is inserted the threaded end 132 of the screw member 128. The threaded end 132 is threaded through a nut member 134 located within the recessed portion 130. Upon rotation of the screw member 128, the nut member 134 is drawn up against the top interior surface of the recessed portion 103 locking the strap member 45 to the drive member 42. It will be seen from this arrangement that the screw members 126 and 128 can easily be shifted along the surface of the drive member 42 to arrange the strap members 44 and 45 to apply a clockwise or counterclockwise rotation to the wrist and forearm during operation of the drive member 42 if so required. It is obvious that the strap members 44 and 45 can be positioned on the drive member 42 so as to provide solely a rectilinear movement of the wrist and arm. In the operation of the apparatus, the patient will be in a sitting position adjacent the housing member 34. The operator will adjust the strap members 44 and 45 to rotate the wrist and forearm in the selected direction and position the arm of the patient on the arm support 38 and using the straps 46, 47 (FIG. 2) anchor the elbow and the upper arm to the arm support member 38. The strap 43 (FIG. 2) is then used to anchor the wrist of the patient to the drive member 42 with the forearm positioned on the support portion 39 of member 38 (FIG. 2). The support member 38 is manually adjusted away from the wrist strap. The operator will turn on the apparatus by pulling out the emergency stop button 49 (FIGS. 2 and 8) resulting in electrical current being applied to the compressor 56 through the pressure switch 55, the cut-off switch 50 and the dual outlet 104 box (FIG. 8). The compressor 56 will fill the tank 54 with compressed air until the pressure gauge 57 indicates a pressure level of approximately 90 psi at which time the pressure switch 55 will operate to disable the compressor 56. The operator will then select the amount of pressure to be applied by operating the manual regulator knob 96 (FIGS. 2 and 8) and set the time interval that pressure is to be applied to the actuator 58 by selectively rotating the dial pointers 116 and 118 (FIG. 9) and starts the operation by depressing the control buttons 122 on the intervalometer 48.

The intervalometer 48 will operate the servo valve 100 allowing air to be supplied to the actuator 58 resulting in the movement of the piston 60. The piston will move the drive member 42 (FIGS. 2–6 inclusive) in a direction which applies pressure on the wrist by means of straps 43–45 inclusive (FIG. 2). The resulting extension and rotation of the arm and wrist causes a reduction in the compression of the palmar tunnel ligament in the manner previously described. The servo valve 100 is of the double acting type which, in one position, will allow air to be supplied to the actuator 58 and hold the air pressure at a constant level and in a second position will relieve the air in the actuator. The piston 60 is spring loaded and will return to its home position once the air pressure in the actuator is released. If during the application of pressure to the wrist, the patient experiences any discomfort, the patient can operate the switch 110 (FIG. 8) which disables the intervalometer 48 operation enabling the servo valve 100 to relieve the air pressure being applied to the actuator 58 in the manner previously described. If an emergency arises where it is necessary to disable the operation of the wrist drive member 42, depressing the stop button 49 (FIGS. 2 and 8) will disrupt the electrical circuit 94 disabling the actuator 58 in the manner previously described. The time interval selected by operation of the time will apply air pressure to the actuator for a selected time period and release the pressure for a selected time period. This sequence is repeated until the time interval elapses or the operator ends the operation by actuating the switch 110 or the stop button 49. It can thus be seen that there has been provided by the present invention a method and apparatus which will effectively supply selected levels of pressure to the wrist of a patient relieving symptoms of carpal tunnel syndrome.

Although the presently preferred embodiment of the invention has been described, it will be understood that various changes may be made within the scope of the appended claims. Thus it is obvious that pressure can be applied to the wrist where the wrist is in any orientation with respect to the elbow.

What is claimed is:

1. A method for treating carpal tunnel syndrome in a patient comprising the steps of:

providing a stationary supporting surface;

securing the forearm to the supporting surface in a generally horizontal position and the upper arm to the supporting surface in a generally vertical direction to restrain the elbow of the patient from movement along the supporting surface in a generally rectilinear direction;

providing a drive member:

securing the patient's wrist to the drive member:

activating said drive member to move the wrist rectilinearly away from the elbow to place said wrist and forearm in traction for a predetermined time period and pressure;

deactivating said drive member after said predetermined time period to discontinue said traction; and intermittently repeating said activating and deactivating steps for a duration determined appropriate to treat the patient.

2. The method of claim 1 which further includes the step of rotating the wrist and forearm during movement of the wrist in a direction away from the elbow.

3. A method for passively stretching an individual's forearm muscles to relax the individual's carpal ligament and maintaining the muscle stretch for a predetermined time period, comprising the steps of:

providing an arm rest having a horizontal upper supporting surface;

positioning the individual alongside the arm rest to enable placing a forearm on said upper supporting surface;

firmly attaching the individual's forearm to said supporting surface adjacent the elbow to restrain the forearm and elbow against longitudinal movement relative to said arm rest;

providing a wrist-encircling harness remote from said elbow in longitudinal alignment with said horizontal supporting surface;

firmly attaching said harness at the base of the individual's hand and about the wrist independently of attachment of said forearm to said arm rest;

applying a predetermined controllable distracting force to the forearm by moving said harness and arm rest relatively longitudinally away from each other to thereby provide a steady stretching tension between the elbow and wrist harness for a predetermined time period; and, upon completion of said predetermined time period, relaxing the distracting force and repeating the foregoing steps a predetermined number of times.

4. The method of claim 3 wherein the arm rest is stationary, and wherein the distracting force is applied solely to said wrist harness.

5. The method of claim 4 wherein a pair of straps are provided at opposite sides of said wrist harness, and wherein said distracting force is applied by pulling on said straps away from the patient's elbow.

6. The method of claim 5 wherein a rotational force is applied to said straps to apply both torsional and longitudinal stretch to said wrist and forearm during application of said distracting force.

7. The method of claim 6 wherein said longitudinal and torsional stretching are simultaneously applied during application of said distracting force.

8. A method for treating carpal tunnel syndrome of a patient comprising the steps of:

providing an arm rest having an upper supporting surface;

securing a patient's forearm to the supporting surface to restrain the patient's elbow against longitudinal movement relative thereto;

providing a harness for the wrist of the secured arm;

firmly encircling the wrist with said harness and fastening the harness in place to resist harness rotation relative to the wrist; and, repetitively applying a controllable outwardly-directed rectilinear force for predetermined time periods between the harness and the restrained elbow to longitudinally and softly distract the forearm and wrist thereby reducing compression of the patient's carpal tunnel ligament, and wherein the rectilinear force is gradually increased in subsequent applications of said method.

9. The method of claim 8 including the additional step of applying a rotational force to said harness to apply torsion to said wrist and forearm while being distracted.

10. The method of claim 9 wherein both said forces are applied simultaneously during said distraction.

11. The method of claim 8 wherein said supporting surface is generally horizontal, and wherein said patient is seated at a seat level below said supporting surface to enable the patient to comfortably rest said forearm horizontally on said supporting surface during treatment.

12. The method of claim 7 including providing a pair of longitudinally-directed reins on horizontally-opposed sides of the harness, said reins extending away from the elbow during treatment, and wherein said pulling force is applied essentially through said reins to said harness and therefrom to said wrist and forearm.

13. The method of claim 12 wherein an air pressure operated means is provided to apply said pulling force, and wherein the ends of said reins remote from said harness are offset vertically and secured to said air pressure operated means, said vertical offset effecting a rotational force to said harness about a horizontal axis as said air pressure operated means applies said pulling force through said reins.

* * * * *